US007604034B2

(12) United States Patent
Woodruff

(10) Patent No.: US 7,604,034 B2
(45) Date of Patent: Oct. 20, 2009

(54) TAPE DISPENSERS

(76) Inventor: Keith F. Woodruff, 1440 Forest Ct., Mountainside, NJ (US) 07092

( * ) Notice: Subject to any disclaimer, the term of this patent is extended or adjusted under 35 U.S.C. 154(b) by 592 days.

(21) Appl. No.: 11/357,309

(22) Filed: Feb. 17, 2006

(65) Prior Publication Data

US 2007/0193693 A1 Aug. 23, 2007

(51) Int. Cl.
*B65H 35/07* (2006.01)
*B32B 38/04* (2006.01)

(52) U.S. Cl. ..... 156/527; 156/574; 156/577; 156/579

(58) Field of Classification Search ..... 156/527, 156/574, 577, 579
See application file for complete search history.

(56) References Cited

U.S. PATENT DOCUMENTS 5,236,540 A * 8/1993 Shi ..... 156/523
5,954,916 A * 9/1999 Orlandi ..... 156/386
6,159,328 A * 12/2000 Gaikoski et al. ..... 156/269
6,705,373 B1 * 3/2004 Yu Chen ..... 156/523
6,848,489 B2 * 2/2005 Lissoni ..... 156/523
2006/0266464 A1 * 11/2006 White ..... 156/247

* cited by examiner

*Primary Examiner*—Mark A Osele
(74) *Attorney, Agent, or Firm*—Mark P. Stone

(57) ABSTRACT

A tape dispenser includes a rotatable support for a tape roll, a rotatable applicator roll, and a swing gate for guiding tape to be dispensed from the tape roll to the applicator roll. The dispenser also includes a cutting element for severing predetermined lengths of tape from the tape roll. A locking element for releasably locking the applicator roll in a stationary position is selectively activated by a trigger to enable the dispensed tape to be firmly applied to a workpiece and to enable the cutting element to more evenly and firmly engage and sever tape from the dispenser.

6 Claims, 4 Drawing Sheets

TAPE DISPENSERS

BACKGROUND OF THE INVENTION

Handheld tape dispensers or applicators are generally known to the art. A typical dispenser includes a handle, a rotatable support for removably receiving a roll of tape to be dispensed, a rotatable applicator wheel for dispensing tape, a swing gate disposed between the tape roll support and the applicator wheel for guiding tape from the tape roll to the applicator wheel, a cutting element disposed upstream from the applicator wheel for severing selected lengths of tape, and a smoothing tab extending from the tape dispenser and located upstream from the cutting element for pressing dispensed tape against a workpiece before the tape is severed from the tape roll. In operation, the free end of a strip of tape unwound from the tape roll is applied to the workpiece and the tape dispenser, which includes a handle held by a user, is moved relative to the workpiece so that tape is unwound from the rotatable tape roll. When the desired length of tape is unwound and applied to the workpiece, the dispenser is moved relative to the strip of tape unwound from the tape roll so that the cutting element engages and severes the tape in a desired predetermined length to be applied to the workpiece.

A conventional tape dispenser has no positive locking means for the rotatable applicator wheel. Accordingly, it is difficult to firmly apply a strip of unwound tape to a workpiece as a result of rotation by the applicator wheel when the strip is being applied to the workpiece. Similarly, it is difficult to firmly and evenly cut tape by the cutting element since the rotatable applicator wheel permits tape to continue to advance as the cutting element engages the tape to be severed.

It is the primary object of the present invention to provide an improved tape dispenser or applicator which overcomes the disadvantages of the known prior art devices. In particular, the tape dispenser in accordance with the present invention provides positive locking means for releasably locking the applicator wheel (or the support for the tape roll, or the tape roll itself) in a stationary position, at the selection of the user, to firmly apply dispensed tape to a workpiece, and to firmly and evenly sever preselected lengths of tape unwound from the tape roll.

Other advantages and improvements of the invention will be apparent to those skilled in the art from the accompanying drawings and the following description thereof.

SUMMARY OF THE INVENTION

An improved handheld tape dispenser or applicator includes a handle, a rotatable support for removably receiving a tape roll, a rotatable applicator wheel, a swing gate disposed between the support for the tape roll and the applicator wheel for guiding tape unwound from the tape roll to the applicator wheel, a cutting element disposed upstream of the rotatable applicator wheel for severing strips of unwound tape to be dispensed, and a smoothing tab disposed upstream from the cutting element and adapted to apply a force to unwound tape applied to a workpiece. The dispenser also includes means for selectively and releasably locking the rotatable applicator wheel in a stationary position to prevent rotation of the applicator wheel to enable tape dispensed from the dispenser to be firmly applied to a workpiece, and to enable the cutting element to firmly and evenly sever strips of tape unwound from the dispenser without slipping or skidding which would occur if the applicator wheel rotated during the cutting operation.

In the preferred embodiment of the invention, the locking means are provided by a trigger mechanically coupled to a member which is adapted to engage the swing gate and hold it firmly against the applicator wheel when the trigger is activated. As a result of the holding force applied by the swing gate to the applicator wheel when the trigger is activated, rotation of the applicator wheel is prevented when the trigger is activated. Therefore, the user of the dispenser preferably will activate the trigger to lock the applicator wheel in a stationary position to increase the tension on the unwound tape before it is severed from the dispenser so that the tape is firmly applied to the workpiece. Additionally, the trigger will preferably be actuated when the tape is severed from the dispenser by the cutting element so as to provide a firm and even cut.

Although the locking means of the preferred embodiment of the invention is provided by a member (the swing gate) being selectively moved into engagement with the applicator wheel to prevent rotatiaon of the applicator wheel upon actuation of a trigger in a handle of the device, the invention is not limited to this specific embodiment, and covers other structure and arrangement of structure permitting the user of the dispenser to selectively and releasably prevent tape from unwinding from the tape roll. For example, the locking means may instead act directly on the tape roll, or directly on the rotatable support for the tape roll, for selectively and releasably locking the tape roll or the tape roll support in a stationary position to prevent additional tape from being unwound from the tape roll.

The tape dispenser in accordance with the present invention permits a user to selectively prevent additional tape from being unwound from a tape roll after a predetermined length of tape has been unwound. This, in turn, enables the user to firmly and evenly apply dispensed tape to a workpiece, and to firmly and evenly sever the dispensed tape in predetermined selected lengths.

DESCRIPTION OF THE BEST MODES FOR CARRYING OUT THE INVENTION

Figure 1:
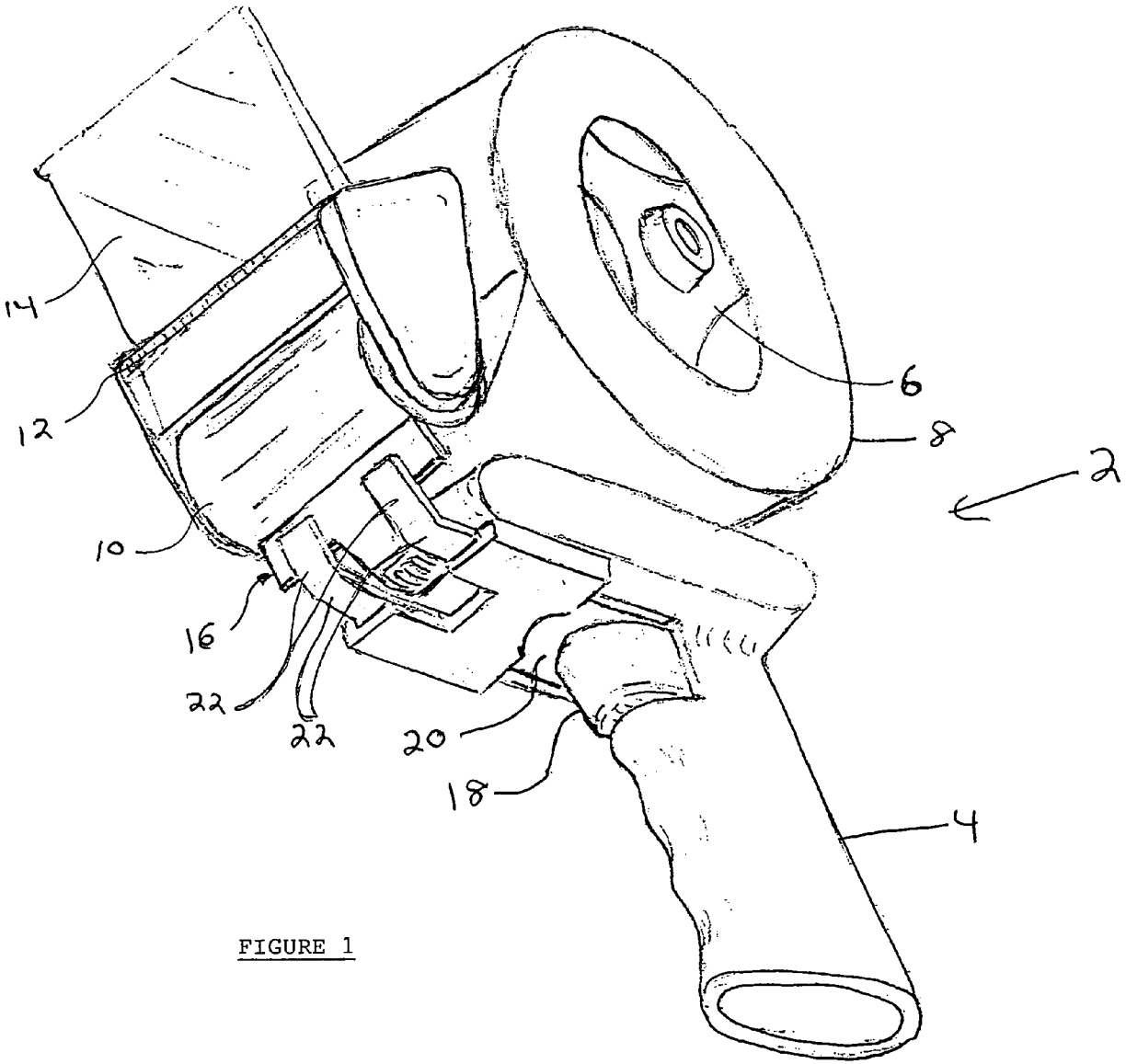
FIG. 1 is a perspective view of a tape dispenser in accordance with the preferred embodiment of the present invention.

FIG. 1 illustrates a handheld tape dispenser, designated generally by the reference numeral 2, in accordance with the preferred embodiment of the present invention. The dispenser includes a handle 4, a rotatable spool 6 for rotatably supporting a removable tape roll 8, a rotatable applicator wheel 10, a cutting element 12, and a tab 14 extending from the forward end of the tape dispenser. A swing gate 16 formed from a resilient or flexible material is disposed between the rotatable spool 6 and the rotatable applicator wheel 10 for guiding tape from the tape roll 8 to the applicator wheel 10.

In operation, tape is unwound from the tape roll 8 by rotation of the supporting spool 6. The unwound tape is guided through the swing gate 16 to the applicator wheel 10, over the cutting element 12, and below the tab 14. The free end of the unwound tape is applied to a workpiece, as for example, a carton to be sealed. When the desired length of tape has been unwound, the cutting teeth of the cutting element 12 are brought into engagement with the unwound section of tape to sever a desired length or strip of the tape.

The structure and operation described above is conventional and known to the art. In the known handheld tape dispensers, it is difficult to firmly apply unwound tape to a workpiece, and to evenly sever unwound tape from the tape roll, because both the tape roll support 6 and the applicator wheel 10 are rotatable during the application of tape to a workpiece after the desired length of tape has been unwound from the tape roll, and during severing of the tape. To overcome the known disadvantages of conventional tape dispensers, the improved tape dispenser illustrated by FIG. 1 includes a retractable trigger 18 in the handle 4, and a locking member 20, having a locking element 22 intregrally defined at the forward end thereof, cooperating with the trigger 18. When the trigger is depressed, the locking member 20 slides into a retracted position, causing the locking element 22 to engage swing gate 16 and hold it firmly against the applicator wheel 10, thereby preventing rotation of the applicator wheel. By preventing rotation of the applicator wheel, the tension on tape unwound from the dispenser and applied to a workpiece can be increased by moving the dispenser away from the workpiece. In this manner, the section of unwound tape extending from the dispenser is firmly and smoothly applied to the workpiece. When the desired length of tape is applied to the workpiece, the dispenser is moved relative to the section of unwound tape so that the cutting element 12 engages the tape, which is still under tension, to firmly and evenly sever the tape from the dispenser. Since rotation of the applicator wheel continues to be prevented by the locking element during the severing operation, the cutting element is able to firmly and evenly cut the tape in predetermined lengths selected by the user.

Preferably, the trigger 18 is spring biased into its extended position so that when any force is removed from the trigger, the locking element will automatically disengage from the swing gate 16. The swing gate 16 is formed from a flexible or resilient material, or is otherwise biased in a direction away from the applicator wheel 10, so as to define a gap between the free end of the swing gate and the outer surface of the applicator wheel. However, when a force is exerted on the swing gate urging it in a direction towards the applicator wheel, such as a force applied by the locking element 20, 22 when actuated by the trigger 18, the free end of the swing gate engages the outer surface of the applicator wheel to prevent rotation thereof until the force is released.

Preferably, the trigger 18 is integrally connected to the slideable locking member 20 which engages the swing gate to cause it to engage the applicator wheel to prevent additional tape from being dispensed from the tape roll during the time of engagement. The trigger 18 on the handle 4 is preferably biased in a position in which the locking member 20 is in its unlocked position (i.e., the locking means 20, 22 does not engage the applicator wheel 10). Therefore, it is necessary for the user to depress the trigger to actuate the locking means, which automatically moves into its unlocked position after the force applied by the user on the trigger is released. Moreover, in the preferred embodiment of the invention, the trigger should be sufficiently long so as to enable a user to depress the trigger to actuate the locking means with at least three (3) fingers.

The locking means illustrated by FIG. 1 includes a slideable component defining two integral free ends for selectively engaging the swing gate upon actuation of the trigger. However, any other locking means for selectively preventing rotation of the applicator wheel can be employed in the present invention. Moreover, although the embodiment of the improved tape dispenser illustrated by FIG. 1 shows a structural arrangement in which locking means are provided to selectively engage the rotatable applicator wheel to prevent rotation thereof, its is within the scope of the present invention to provide alternative locking means which are arranged to selectively engage either the rotatable tape roll 8 or the rotatable spool 6 for supporting the tape roll, to selectively prevent rotation of the tape roll 8 or the supporting spool 6, instead of locking means which are arranged to selectively prevent rotation of the applicator wheel 10. Stated in other words, the locking means in accordance with the improved tape dispenser are arranged to act directly on either the applicator wheel, the tape roll, or the supporting tape spool, to result in the same functional advantages as discussed herein, namely to selectively prevent additional tape from unwinding when unwound tape is being applied to a workpiece, or severed from the tape roll.

Figure 2:
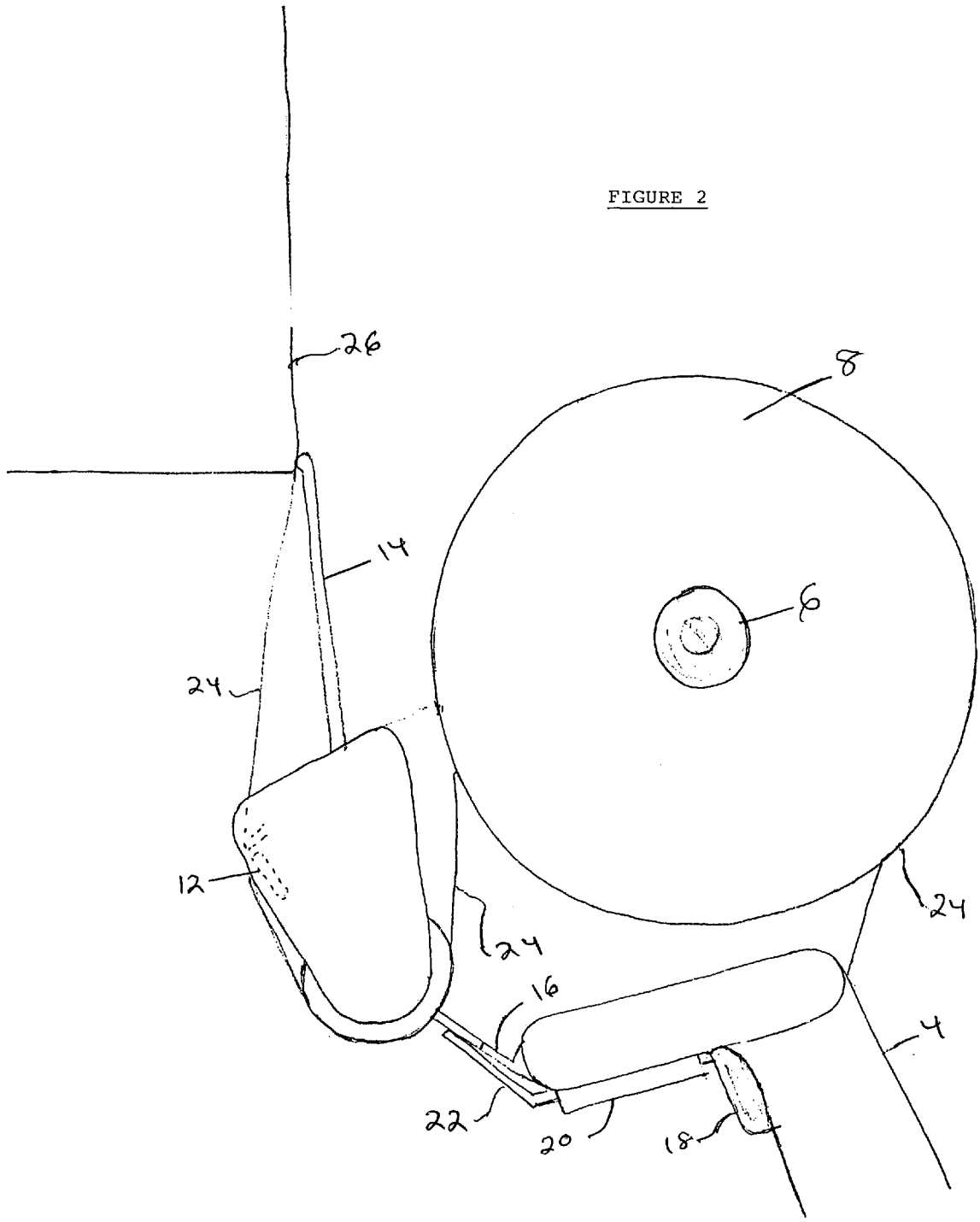
FIG. 2 is a side elevational view of a portion of the tape dispenser illustrated by FIG. 1 in which dispensed tape is being applied to a carton.

FIG. 2 is a side elevational view of a portion of the tape dispenser illustrated by FIG. 1, showing the improved tape dispenser in its locked position. The same reference numerals are used in FIG. 2 to designate the same elements illustrated in FIG. 1. FIG. 2 illustrates the trigger 18 in a depressed position so that the remote end 22 of the locking member 20 engages the resilient swing gate 16, forcing the free end of the swing gate into engagement with the outer surface of the applicator wheel 10. As a result of the engagement of the swing gate and the applicator wheel, rotation of the applicator wheel is prevented. As illustrated by FIG. 2, a portion of the tape 24 extending through the dispenser engages a workpiece 26 which, for illustrative purposes, is a carton to be taped. Because the applicator wheel 10, which receives a portion of the unwound tape 24 over its outer surface, cannot rotate when the swing gate engages the applicator wheel, movement of the tape dispenser relative to the carton 26 increases the tension in the section of the tape 24 extended from the dispenser, thereby enabling the tape to firmly engage and seal the carton. Additionally, when the tape dispenser is moved so that the cutting element 12 engages the extended portion of the unwound tape 24 which is still under increased tension, the tape is evenly and firmly severed from the tape dispenser. As noted above, although the locking means of the tape dispenser illustrated by FIGS. 1 and 2 acts directly on the applicator wheel to prevent rotation thereof, it is within the scope of the present invention to provide locking means which act directly on the tape roll or the supporting spool 6 for the tape roll to prevent rotation thereof and result in the same functional advantages discussed herein. It is therefore apparent from the present discussion that the releasable locking means in accordance with the present invention is adapted to prevent additional tape from unwinding from the tape roll at the selection of the user during predetermined time intervals namely, when the tape is being applied to a workpiece, and when the tape is being severed from the tape roll by the cutting element. Any suitable mechanical releasable locking means enabling the user to selectively prevent tape from unwinding from the tape roll can be employed in the present invention.

Figure 3:
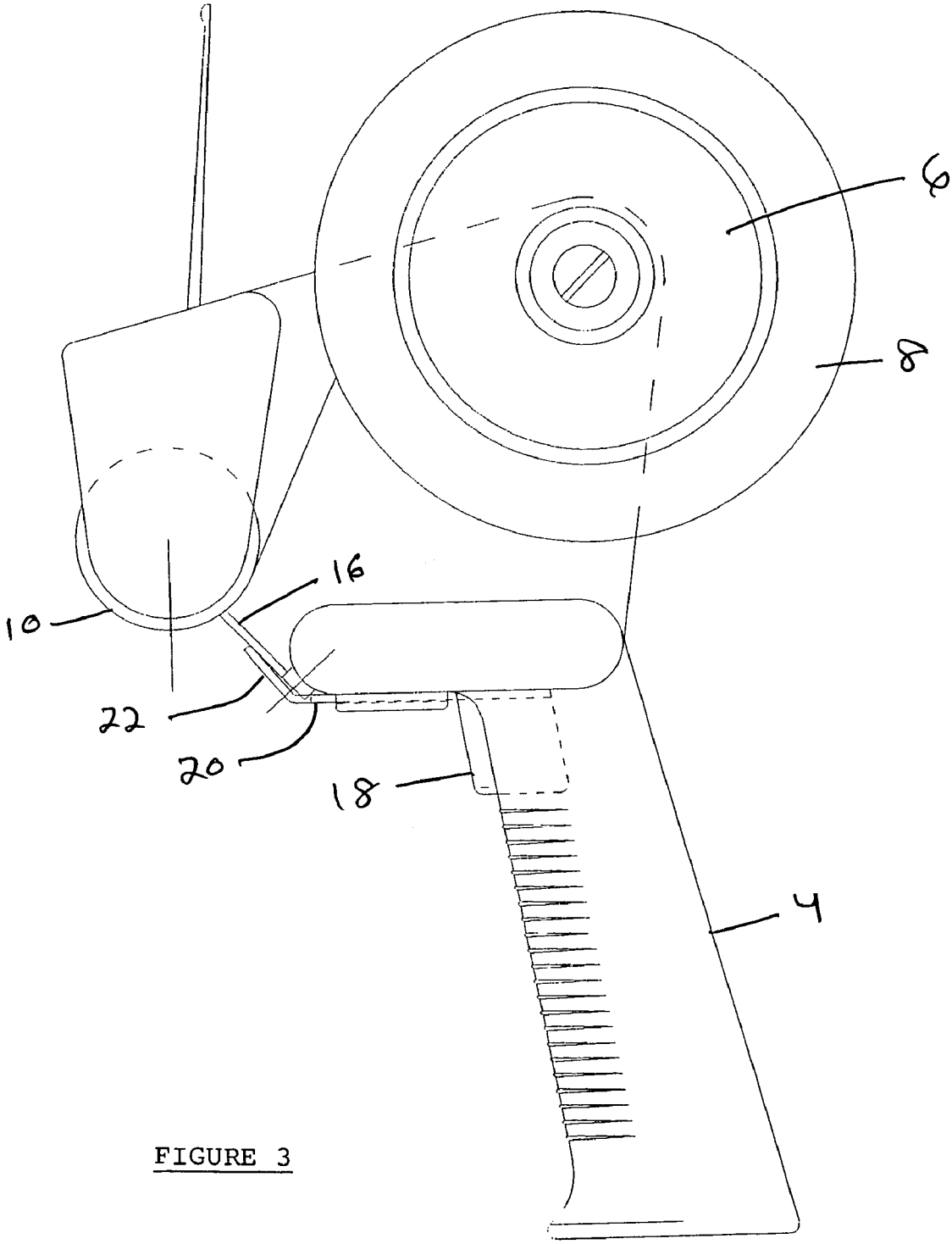
FIG. 3 is a side elevational view of the tape dispenser illustrated by FIG. 1 showing tape being dispensed from the dispenser.

FIG. 3 illustrates a side elevational view of the tape dispenser illustrated by FIGS. 1 and 2. The same reference numerals have been used to identify the same elements. FIG. 3 illustrates the tape dispenser in its unlocked position in which swing gate 16 does not engage the outer surface of the applicator wheel 10, to permit a tape to continue to be dispensed from the tape roll 8.

Figure 4:
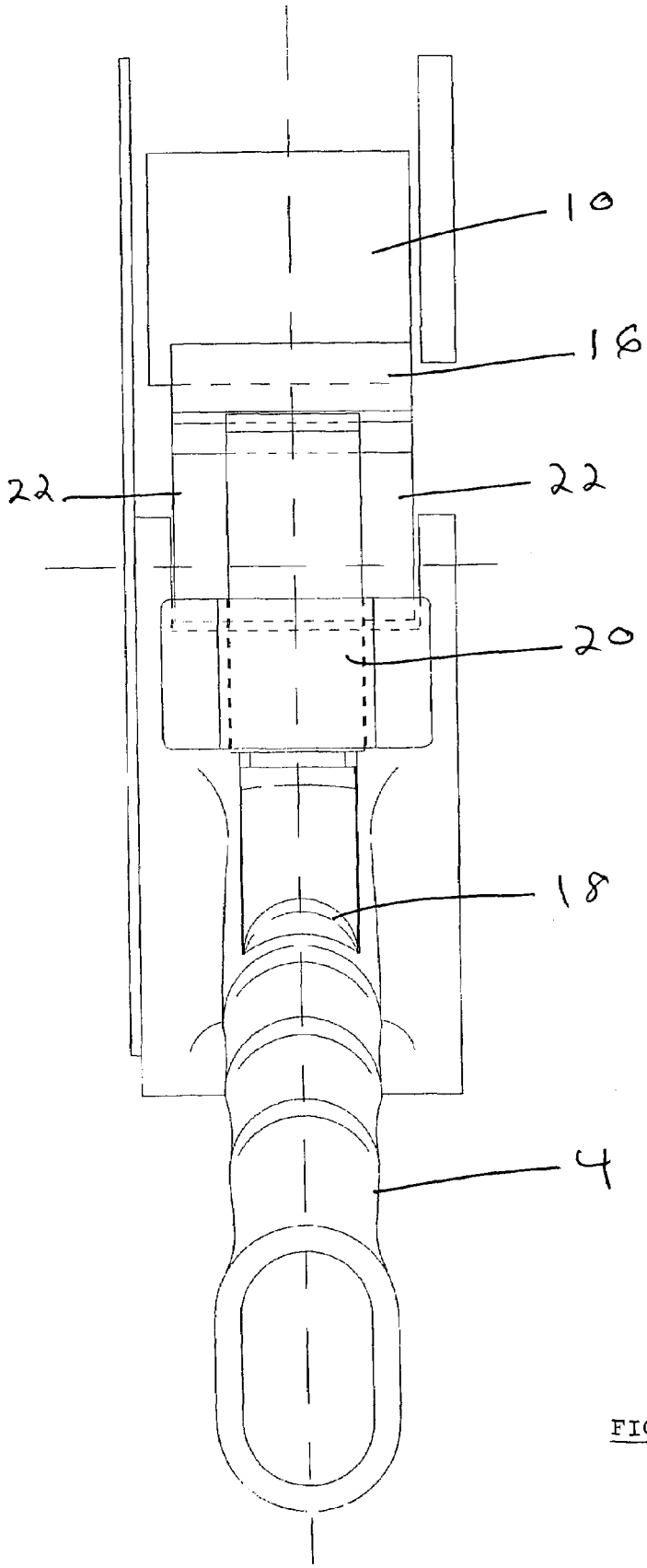
FIG. 4 is a bottom plan view of the tape dispenser illustrated by FIG. 1.

FIG. 4 illustrates a bottom plan view of the tape dispenser illustrated by FIGS. 1-3 of the drawings. The same reference numerals are used to identify the same elements.

The description of the preferred embodiment herein is intended to be illustrative only, and not restrictive of the scope of the invention. Other advantages and modifications within the scope of the invention will become apparent to those skilled in the art. As noted herein, different mechanical means from that discussed herein for releasably locking the tape dispenser at the selection of the user can be employed in the present invention. Accordingly, the scope of the invention is not limited to that of the preferred embodiment of the tape dispenser disclosed and illustrated herein, said scope being defined by the following claims and all equivalents thereto.

The invention claimed is:

1. A tape dispenser comprising:

a handle;

a rotatable spool for removably receiving a roll of tape;

a rotatable applicator wheel for receiving tape unwound from said tape roll;

a swing gate disposed between said rotatable spool and said rotatable applicator wheel for guiding tape between said rotatable spool and said rotatable applicator wheel; and means for selectively preventing tape from unwinding from said tape roll, said means for selectively preventing tape from unwinding including a releasable locking element selectively movable between a locked position and an unlocked position, said locking element being arranged to prevent rotation of said applicator wheel when said locking element is in said locked position, said locking element being adapted to act on said swing gate for causing said swing gate to engage said applicator wheel to prevent rotation thereof when said locking element is in said locked position; and an actuator for selectively moving said locking element between said locked position and said unlocked position, said actuator comprising a trigger on said handle, said trigger being biased in said unlocked position of said locking element, said locking element comprising a sliding component movable into said locked position by actuation of said trigger.

2. The tape dispenser as claimed in claim 1, further including a cutting element disposed forward from said applicator wheel for cutting tape when said locking element is in said locked position.

3. A tape dispenser comprising:

a handle;

a rotatable spool for removably receiving a roll of tape;

a rotatable applicator wheel for receiving tape unwound from said tape roll;

a swing gate disposed between said rotatable spool and said rotatable applicator wheel for guiding tape between said rotatable spool and said rotatable applicator wheel; and means for selectively preventing tape from unwinding from said tape roll, said means for selectively preventing tape from unwinding including a releasable locking element selectively movable between a locked position and an unlocked position; wherein said locking element is arranged to prevent rotation of said spool when said locking element is in said locked position.

4. The tape dispenser as claimed in claim 3, further including a cutting element disposed forward from said applicator wheel for cutting tape when said locking element is in said locked position.

5. A tape dispenser comprising:

a handle;

a rotatable spool for removably receiving a roll of tape;

a rotatable applicator wheel for receiving tape unwound from said tape roll;

a swing gate disposed between said rotatable spool and said rotatable applicator wheel for guiding tape between said rotatable spool and said rotatable applicator wheel; and means for selectively preventing tape from unwinding from said tape roll, said means for selectively preventing tape from unwinding including a releasable locking element selectively movable between a locked position and an unlocked position; wherein said locking element is arranged to prevent rotation of a tape roll on said spool when said locking element is in said locked position.

6. The tape dispenser as claimed in claim 5, further including a cutting element disposed forward from said applicator wheel for cutting tape when said locking element is in said locked position.

* * * * *